US011230099B2

(12) United States Patent
Ishihara et al.

(10) Patent No.: US 11,230,099 B2
(45) Date of Patent: Jan. 25, 2022

(54) INK HEAD

(71) Applicants: KABUSHIKI KAISHA TOSHIBA, Tokyo (JP); Toshiba Tec Kabushiki Kaisha, Tokyo (JP)

(72) Inventors: Haruhiko Ishihara, Yokohama (JP); Masakuni Ikagawa, Ebina (JP); Katsuyuki Soeda, Yokohama (JP); Shizuo Kinoshita, Yokohama (JP)

(73) Assignees: KABUSHIKI KAISHA TOSHIBA, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/135,049

(22) Filed: Dec. 28, 2020

(65) Prior Publication Data

US 2021/0283912 A1 Sep. 16, 2021

(30) Foreign Application Priority Data

Mar. 16, 2020 (JP) ..... JP2020-045586

(51) Int. Cl.
*B41J 2/14* (2006.01)

(52) U.S. Cl.
CPC ..... *B41J 2/14145* (2013.01)

(58) Field of Classification Search
CPC ..... B41J 2/1612; B41J 2/1433; B41J 2/1623; B41J 2/14274; B41J 2/14145; B41J 2002/14491
See application file for complete search history.

(56) References Cited

U.S. PATENT DOCUMENTS

| | | | | |
|---|---|---|---|---|
| 4,751,774 | A | 6/1988 | Deyoung | |
| 4,768,266 | A | 9/1988 | Deyoung | |
| 10,252,528 | B2 * | 4/2019 | Kawakubo | B41J 2/1607 |
| 10,946,655 | B2 * | 3/2021 | Ishihara | B41J 2/1612 |
| 2019/0118534 | A1 * | 4/2019 | Suzuki | B41J 2/14209 |

FOREIGN PATENT DOCUMENTS

| | | | |
|---|---|---|---|
| JP | 2881616 | B2 | 4/1999 |
| JP | 3231523 | B2 | 11/2001 |
| JP | 2013-184447 | A | 9/2013 |

* cited by examiner

*Primary Examiner* — An H Do
(74) *Attorney, Agent, or Firm* — Oblon, McClelland, Maier & Neustadt, L.L.P.

(57) ABSTRACT

An ink head includes: a common ink chamber; a first nozzle including a first nozzle hole, a first flow channel and the common ink chamber, and a first actuator; and a second nozzle including a second nozzle hole, a second flow channel and the common ink chamber, and a second actuator, the second nozzle being adjacent to the first nozzle in a first direction. The first flow channel is linked to the common ink chamber via a first opening. The second flow channel is linked to the common ink chamber via a second opening. A center position of the first opening is shifted from a center position of the second opening in at least a third direction, the third direction crossing the first direction when viewed along a second direction, the second direction being from the common ink chamber toward the first flow channel.

20 Claims, 11 Drawing Sheets

INK HEAD

CROSS-REFERENCE TO RELATED APPLICATIONS

This application is based upon and claims the benefit of priority from the prior Japanese Patent Application No. 2020-045586, filed on Mar. 16, 2020; the entire contents of which are incorporated herein by reference.

FIELD

Embodiments relate to an ink head.

BACKGROUND

A known ink head includes multiple nozzles arranged in one direction, and a common ink chamber. Each nozzle includes a nozzle hole, a flow channel that links the common ink chamber and the nozzle hole, and an actuator that ejects ink from the nozzle hole. When the actuators of the multiple nozzles of such an ink head are simultaneously driven, the ink in the common ink chamber is simultaneously suctioned by the multiple nozzles. When the ink inside the common ink chamber is simultaneously suctioned by adjacent nozzles, there is a possibility that sufficient ink cannot be supplied to each nozzle hole. In such a case, the ink droplets that are ejected from the nozzle holes do not have the prescribed amounts.

DETAILED DESCRIPTION

In general, according to one embodiment, an ink head includes: a common ink chamber configured to contain ink; a first nozzle including a first nozzle hole, a first flow channel linking the first nozzle hole and the common ink chamber, and a first actuator ejecting ink from the first nozzle hole; and a second nozzle including a second nozzle hole, a second flow channel linking the second nozzle hole and the common ink chamber, and a second actuator ejecting ink from the second nozzle hole, the second nozzle being adjacent to the first nozzle in a first direction. The first flow channel is linked to the common ink chamber via a first opening. The second flow channel is linked to the common ink chamber via a second opening. A center position of the first opening is shifted from a center position of the second opening in at least a third direction, the third direction crossing the first direction when viewed along a second direction, the second direction being from the common ink chamber toward the first flow channel.

First Embodiment

First, a first embodiment will be described.

Figure 1:
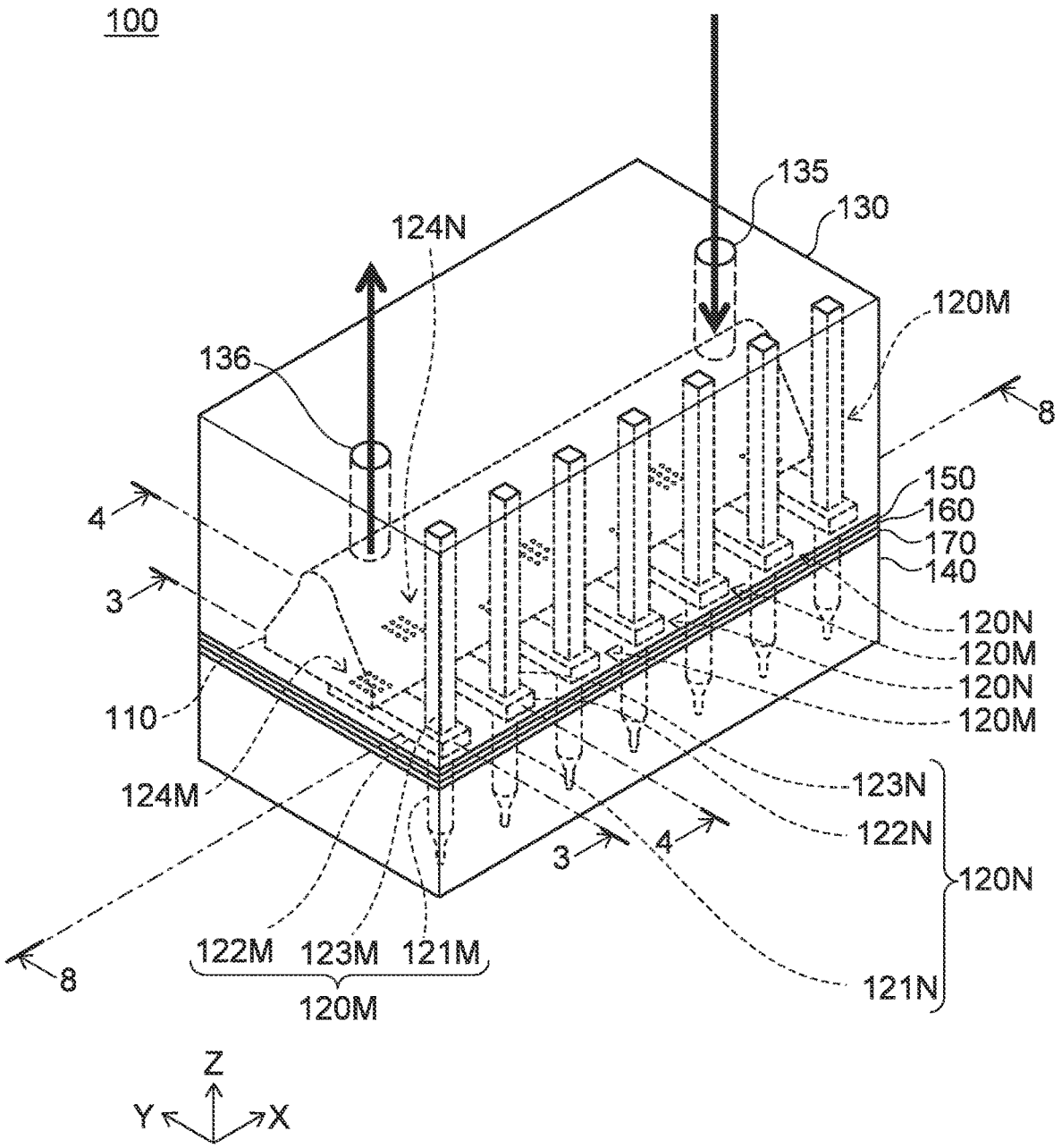
FIG. 1 is a perspective view showing an ink head according to a first embodiment.

FIG. 1 is a perspective view showing an ink head according to the embodiment.

Figure 2:
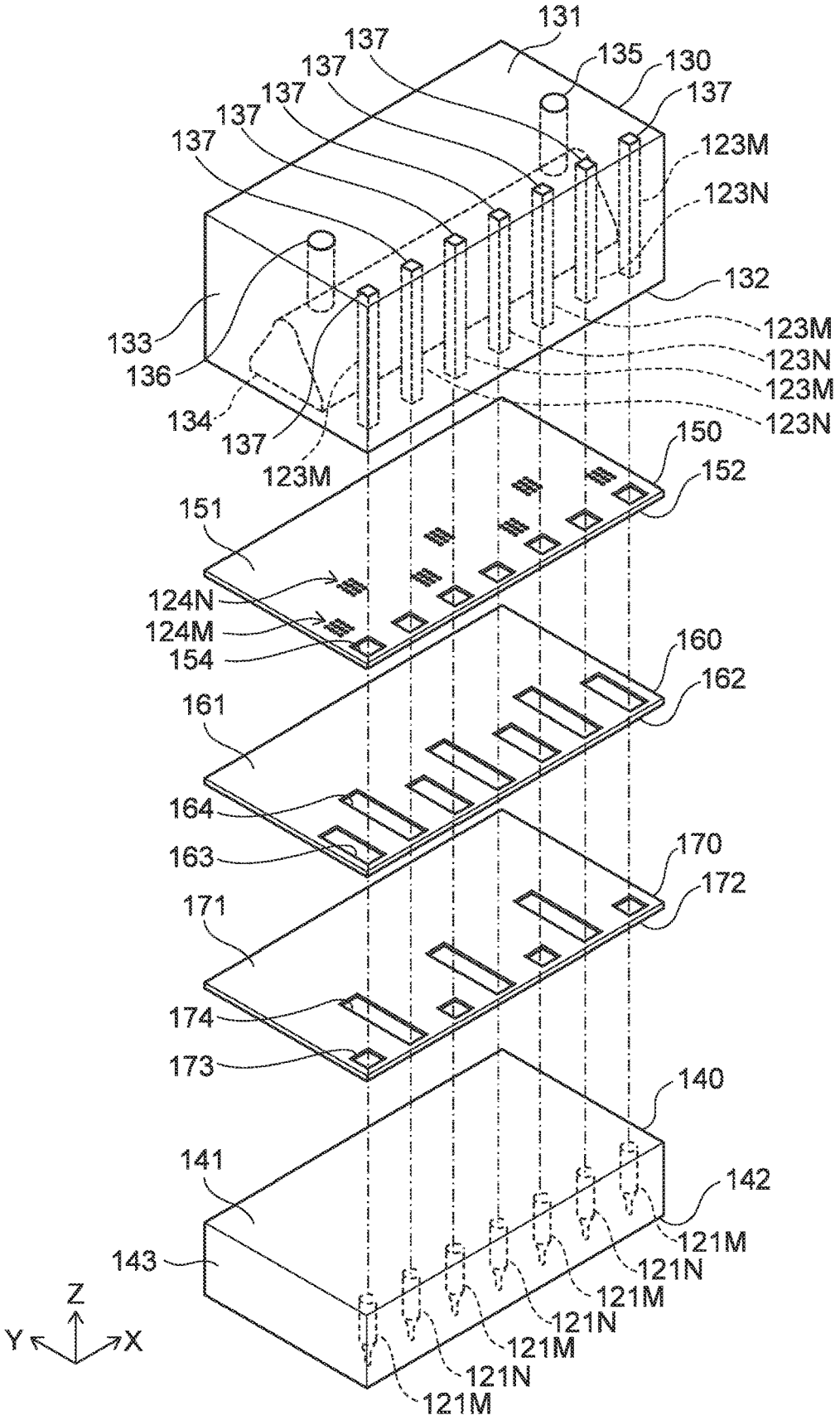
FIG. 2 is an exploded perspective view showing the ink head according to the first embodiment.

FIG. 2 is an exploded perspective view showing the ink head according to the embodiment.

Figure 3:
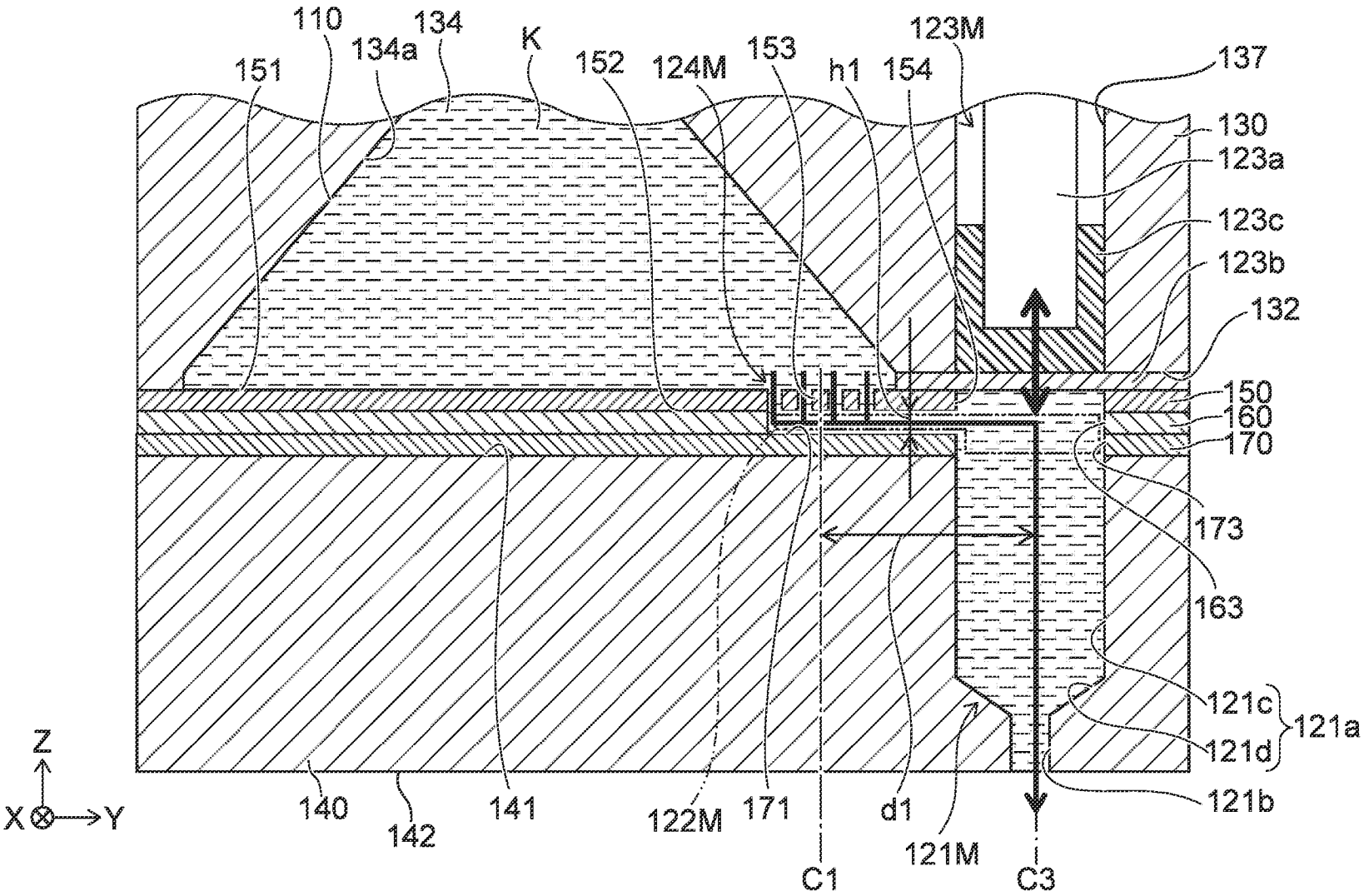
FIG. 3 is a partial end view along line 3-3 of FIG. 1.

FIG. 3 is a partial end view along line 3-3 of FIG. 1.

Figure 4:
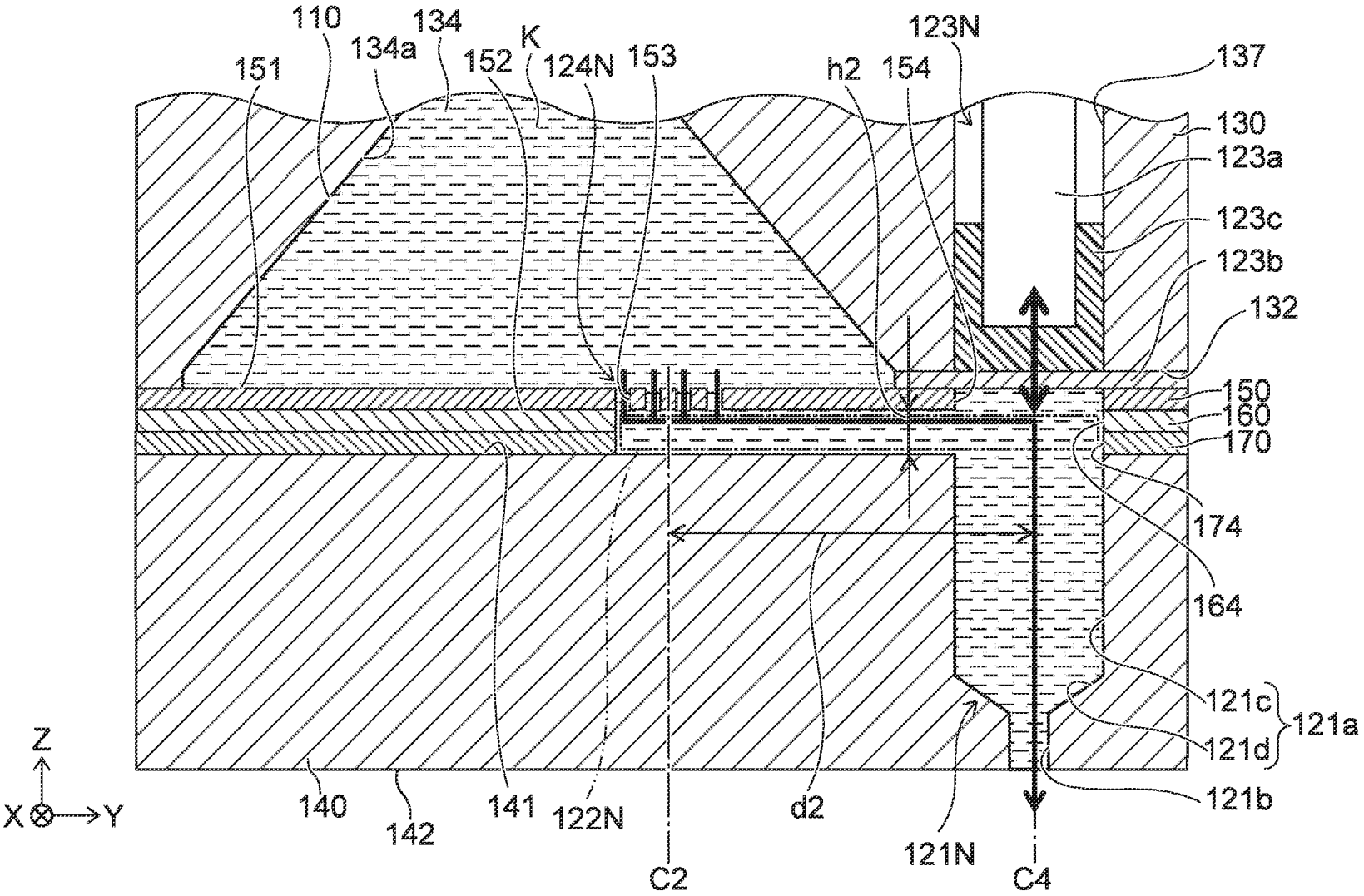
FIG. 4 is a partial end view along line 4-4 of FIG. 1.

FIG. 4 is a partial end view along line 4-4 of FIG. 1.

Generally speaking, as shown in FIG. 1, the ink head 100 according to the embodiment includes a common ink chamber 110, multiple first nozzles 120M, and multiple second nozzles 120N. The multiple first nozzles 120M and the multiple second nozzles 120N are alternately arranged in one direction.

Each first nozzle 120M includes a first nozzle hole 121M, a first flow channel 122M that links the first nozzle hole 121M and the common ink chamber 110, and a first actuator 123M that ejects ink K from the first nozzle hole 121M. Each first flow channel 122M is linked to the common ink chamber 110 via a first opening 124M.

Each second nozzle 120N includes a second nozzle hole 121N, a second flow channel 122N that links the second nozzle hole 121N and the common ink chamber 110, and a second actuator 123N that ejects the ink K from the second nozzle hole 121N. Each second flow channel 122N is linked to the common ink chamber 110 via a second opening 124N.

The ink head 100 is mounted in an inkjet printer. A controller of the inkjet printer controls the actuators 123M and 123N of the ink head 100 to eject the ink K from the nozzle holes 121M and 121N.

The components of the ink head 100 will now be elaborated. Hereinbelow, an XYZ orthogonal coordinate system is used for easier understanding of the description. The direction in which the first nozzle 120M and the second nozzle 120N are arranged is called an "X-direction". A direction orthogonal to the X-direction from the first flow channel 122M toward the common ink chamber 110 is called a "Z-direction" or an upward direction. The reverse direction of the Z-direction is called a "downward direction". The components of the ink head 100 when viewed along the downward direction are referred to as "when viewed in top-view". One direction orthogonal to the X-direction and the Z-direction is called a "Y-direction".

As shown in FIG. 2, the ink head 100 according to the embodiment includes a first block 130, a second block 140, a first plate 150, a second plate 160, and a third plate 170.

The first block 130 is, for example, a substantially rectangular parallelepiped. The surfaces of the first block 130 include an upper surface 131, a lower surface 132, and a side surface 133. The upper surface 131 is, for example, a flat surface parallel to the X-direction and the Y-direction. The lower surface 132 is positioned at the side opposite to the upper surface 131. The lower surface 132 is, for example, a flat surface parallel to the X-direction and the Y-direction. The side surface 133 is positioned between the upper surface 131 and the lower surface 132.

The second block 140 is, for example, a substantially rectangular parallelepiped. The surfaces of the second block 140 include an upper surface 141, a lower surface 142, and a side surface 143. The upper surface 141 is, for example, a flat surface parallel to the X-direction and the Y-direction. The lower surface 142 is positioned at the side opposite to the upper surface 141. The lower surface 142 is, for example, a flat surface parallel to the X-direction and the Y-direction. The side surface 143 is positioned between the upper surface 141 and the lower surface 142.

The surfaces of the first plate 150 include an upper surface 151 and a lower surface 152. The upper surface 151 is a flat surface parallel to the X-direction and the Y-direction. The lower surface 152 is positioned at the side opposite to the upper surface 151. The lower surface 152 is a flat surface parallel to the X-direction and the Y-direction.

The surfaces of the second plate 160 include an upper surface 161 and a lower surface 162. The upper surface 161 is a flat surface parallel to the X-direction and the Y-direction. The lower surface 162 is positioned at the side opposite to the upper surface 161. The lower surface 162 is a flat surface parallel to the X-direction and the Y-direction. Accordingly, the thickness (the dimension in the Z-direction) of the second plate 160 is substantially constant at each position in the X-direction and the Y-direction.

The surfaces of the third plate 170 include an upper surface 171 and a lower surface 172. The upper surface 171 is a flat surface parallel to the X-direction and the Y-direction. The lower surface 172 is positioned at the side opposite to the upper surface 171. The lower surface 172 is a flat surface parallel to the X-direction and the Y-direction. Accordingly, the thickness (the dimension in the Z-direction) of the third plate 170 is substantially constant at each position in the X-direction and the Y-direction.

The third plate 170 is provided on the second block 140. The second plate 160 is provided on the third plate 170. The first plate 150 is provided on the second plate 160. The first block 130 is provided on the first plate 150. In the embodiment as shown in FIG. 1, the common ink chamber 110, the multiple first nozzles 120M, and the multiple second nozzles 120N are provided in a stacked body made of the first block 130, the second block 140, the first plate 150, the second plate 160, and the third plate 170.

As shown in FIG. 2, a space 134 that is open at the lower surface 132 is provided in the first block 130. The space 134 extends in the X-direction. As shown in FIGS. 3 and 4, the common ink chamber 110 is defined by an inner wall 134*a* of the space 134 and the upper surface 151 of the first plate 150. The ink K is contained in the common ink chamber 110.

As shown in FIGS. 1 and 2, an ink-supply flow channel 135 and an ink-discharge flow channel 136 that are linked to the space 134 (the common ink chamber 110) are provided in the first block 130. The ink-supply flow channel 135 and the ink-discharge flow channel 136 are linked to an ink tank provided in the inkjet printer when mounted in the inkjet printer. The common ink chamber 110 receives the ink K from the ink tank via the ink-supply flow channel 135. Also, the common ink chamber 110 discharges the ink K into the ink tank via the ink-discharge flow channel 136. Therefore, the ink that is inside the common ink chamber 110 can circulate via the ink-supply flow channel 135 and the ink-discharge flow channel 136.

As shown in FIG. 2, multiple through-holes 137 that extend through the first block 130 in the vertical direction are provided in the first block 130. The multiple through-holes 137 are arranged at substantially uniform spacing in the X-direction. A portion of the first actuator 123M or a portion of the second actuator 123N is located in each through-hole 137. The multiple first actuators 123M and the multiple second actuators 123N are alternately arranged in the X-direction.

As shown in FIG. 3, the first actuators 123M are respectively positioned directly above the first nozzle holes 121M. As shown in FIG. 4, the second actuators 123N are respectively positioned directly above the second nozzle holes 121N.

In the embodiment, the actuators 123M and 123N are piezoelectric actuators. Specifically, the actuators 123M and 123N each include a piezoelectric element 123*a* and a vibrating membrane 123*b*. The piezoelectric element 123*a* is located inside the through-hole 137. The piezoelectric element 123*a* is bonded to the inner wall of the through-hole 137 by a bonding member 123*c*. For example, the bonding member 123*c* is made of an elastic resin material. The vibrating membrane 123*b* is mounted to the lower surface of the bonding member 123*c* and a region of the lower surface 132 of the first block 130 at the periphery of the lower surface of the bonding member 123*c*. The vibrating membrane 123*b* individually covers and seals the lower surface 132 side of the through-hole 137 of the first block 130.

The piezoelectric element 123*a* is electrically connected to the controller of the inkjet printer in a state in which the ink head 100 is mounted in the inkjet printer. The controller causes the piezoelectric element 123*a* to expand and contract in the Z-direction by applying, for example, a pulse voltage in the Z-direction of the piezoelectric element 123*a*. Thereby, the portions of the bonding member 123*c* and the vibrating membrane 123*b* positioned directly under the piezoelectric element 123*a* vibrate in the Z-direction. Thereby, pressure waves of the ink K are produced inside the nozzle holes 121M and 121N positioned directly under the actuators 123M and 123N. As a result, the ink K protrudes from the lower ends of the nozzle holes 121M and 121N. The ink K that protrudes from the nozzle holes 121M and 121N gradually becomes large and separates from the nozzle holes 121M and 121N. Thereby, droplets of the ink K are ejected from the nozzle holes 121M and 121N.

However, instead of a pulse voltage, the controller may apply an alternating current voltage to the piezoelectric element 123*a*. The structures of the first and second actuators are not limited to those described above. For example, the first and second actuators each may include a heater, and the ink may be ejected from the nozzle hole by producing a bubble by the heater heating a portion of the ink inside the nozzle hole.

As shown in FIG. 2, the multiple first nozzle holes 121M and the multiple second nozzle holes 121N are provided in the second block 140. The multiple first nozzle holes 121M and the multiple second nozzle holes 121N are alternately arranged at substantially uniform spacing in the X-direction.

As shown in FIGS. 3 and 4, the nozzle holes 121M and 121N extend through the second block 140 in the Z-direction. The nozzle holes 121M and 121N each have an individual ink chamber 121*a* and a nozzle hole tip 121*b*. The individual ink chamber 121*a* is open at the upper surface 141 of the second block 140. The individual ink chamber 121*a* includes a circular columnar first portion 121*c*, and a truncated circular conic second portion 121*d* connected to the lower end of the first portion 121*c*. The diameter of the second portion 121*d* decreases along the downward direction. The nozzle hole tip 121*b* is connected to the lower end of the second portion 121*d* and is open at the lower surface 142 of the second block 140. The diameter of the nozzle hole tip 121*b* is substantially constant along the Z-direction. However, the shapes of the nozzle holes 121M and 121N are not limited to those described above.

Figure 5:
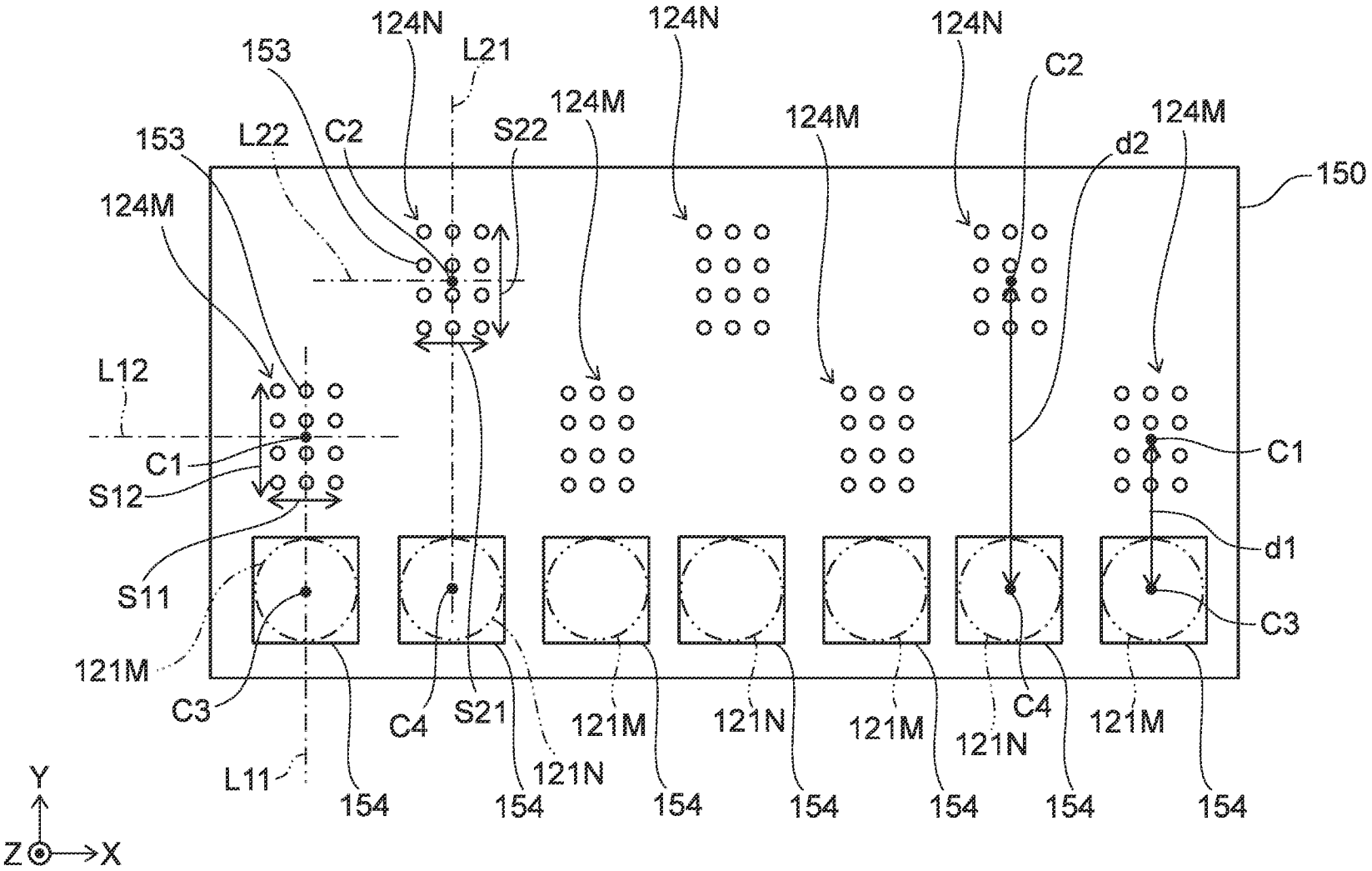
FIG. 5 is a top view showing a first plate of the ink head according to the first embodiment.

FIG. 5 is a top view showing the first plate of the ink head according to the embodiment.

The multiple first openings 124M and the multiple second openings 124N are provided in the first plate 150.

In the embodiment, the openings 124M and 124N each are made of multiple through-holes 153 extending through the first plate 150 in the Z-direction. Each through-hole 153 is, for example, circular when viewed in top-view. In the example shown in FIG. 5, one first opening 124M is made of a total of twelve through-holes 153 having three columns in the X-direction and four rows in the Y-direction; and one second opening 124N is made of a total of twelve through-holes 153 having three columns in the X-direction and four rows in the Y-direction. However, the number of the through-holes 153 included in each of the openings 124M and 124N is not limited to that described above. For example, the number of the through-holes 153 included in each of the openings 124M and 124N may be one. Also, the number of the through-holes 153 included in the first opening 124M and the number of the through-holes 153 included in the second opening 124N may not be equal.

The multiple first openings 124M and the multiple second openings 124N are arranged alternately in a staggered configuration in the X-direction. Therefore, a center position C1 of the first opening 124M and a center position C2 of the second opening 124N are shifted in the Y-direction. The "center position C1 of the first opening 124M" means the intersection between a straight line L11 that extends in the Y-direction and passes through the X-direction center of a range S11 in which the first opening 124M is provided and a straight line L12 that extends in the X-direction and passes through the Y-direction center of a range S12 in which the first opening 124M is provided. Similarly, the "center position C2 of the second opening 124N" means the intersection between a straight line L21 extending in the Y-direction and passing through the X-direction center of a range S21 in which the second opening 124N is provided and a straight line L22 extending in the X-direction and passing through the Y-direction center of a range S22 in which the second opening 124N is provided.

As shown in FIGS. 3 and 4, the first openings 124M and the second openings 124N are located directly under the common ink chamber 110 and are linked to the common ink chamber 110.

In FIG. 5, projections of the nozzle holes 121M and 121N on the first plate 150 are illustrated by double dot-dash lines for easier understanding of the positional relationship between the openings 124M and 124N and the nozzle holes 121M and 121N. When viewed in top-view, a center position C3 of the first nozzle hole 121M is positioned on the straight line L11 extending in the Y-direction and passing through the center position C1 of the first opening 124M. Similarly, when viewed in top-view, a center position C4 of the second nozzle hole 121N is positioned on the straight line L21 extending in the Y-direction and passing through the center position C2 of the second opening 124N. A distance d1 in the Y-direction between the center position C1 of the first opening 124M and the center position C3 of the first nozzle hole 121M is less than a distance d2 in the Y-direction between the center position C2 of the second opening 124N and the center position C4 of the second nozzle hole 121N (d1<d2).

In the embodiment, the range S12 in which the first opening 124M is provided and the range S22 in which the second opening 124N is provided do not overlap in the Y-direction. In other words, the first opening 124M and the second opening 124N are not adjacent to each other in the X-direction. However, the range in which the first opening is provided and the range in which the second opening is provided may partially overlap in the Y-direction. In other words, a portion of the first opening and a portion of the second opening may be adjacent to each other in the X-direction.

Multiple through-holes 154 are provided in the first plate 150. The multiple through-holes 154 are arranged along the X-direction. Each through-hole 154 is rectangular when viewed in top-view. However, the shape of each through-hole 154 is not limited to that described above. As shown in FIGS. 3 and 4, each through-hole 154 is located between the first actuator 123M and the first nozzle hole 121M or between the second actuator 123N and the second nozzle hole 121N. Therefore, the vibrating membranes 123*b* of the actuators 123M and 123N individually cover and seal the through-holes 154. Then, the actuators 123M and 123N can cause pressure waves of the ink K inside the nozzle holes 121M and 121N positioned directly under the through-holes 154 via the through-holes 154 provided directly under the actuators 123M and 123N.

Figure 6:
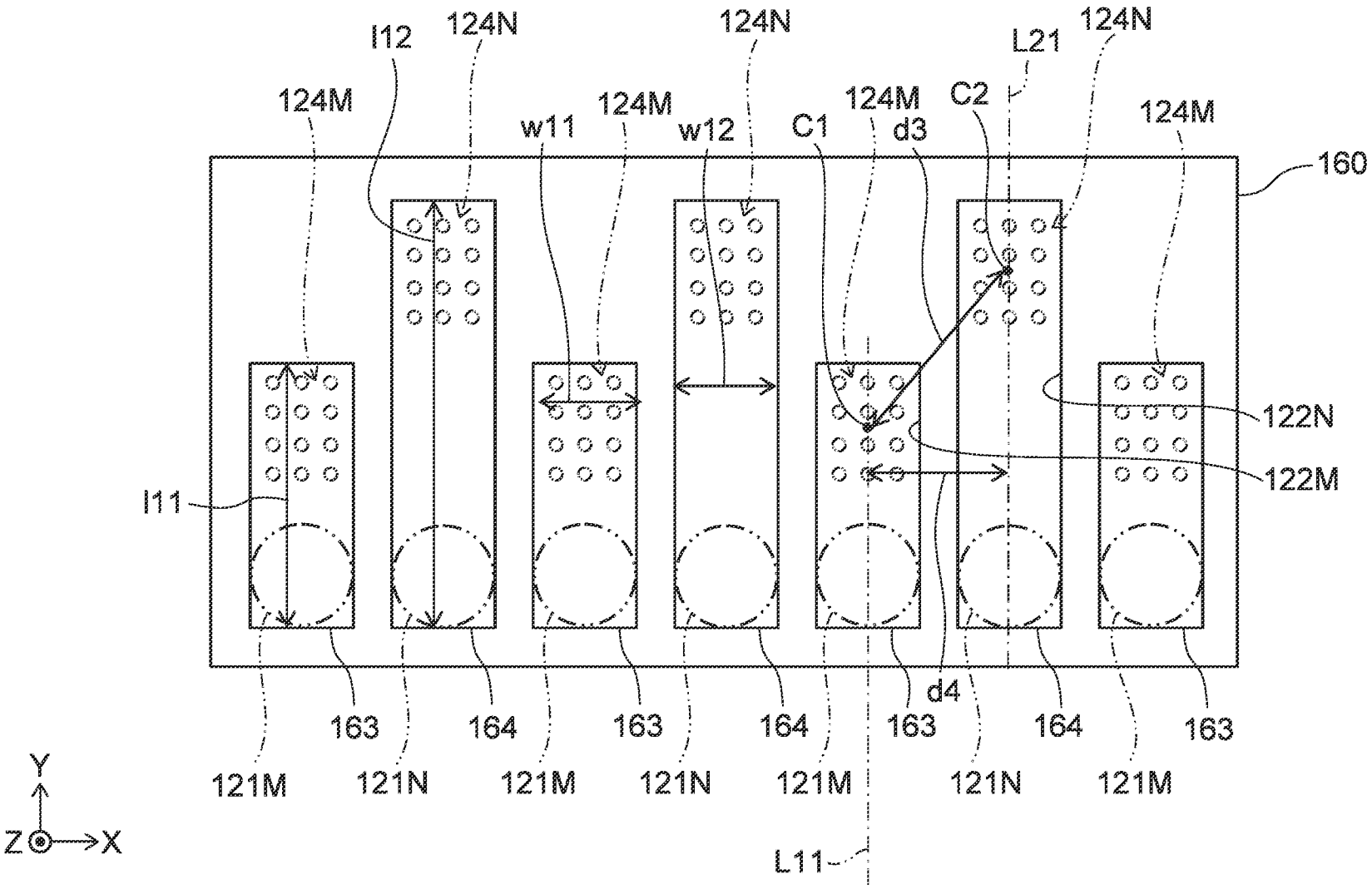
FIG. 6 is a top view showing a second plate of the ink head according to the first embodiment.

FIG. 6 is a top view showing the second plate of the ink head according to the embodiment.

Projections of the openings 124M and 124N and the nozzle holes 121M and 121N on the second plate 160 are illustrated by double dot-dash lines for easier understanding of the description in FIG. 6.

Multiple first through-holes 163 and multiple second through-holes 164 are provided in the second plate 160. The multiple first through-holes 163 and the multiple second through-holes 164 are alternately arranged in the X-direction.

Each first through-hole 163 is rectangular when viewed in top-view. A dimension w11 (the width) in the X-direction of the first through-hole 163 is substantially constant at each position in the Y-direction. The X-direction center position of the first through-hole 163 is positioned on the straight line L11 passing through the center position C1 of the first opening 124M.

Each second through-hole 164 is rectangular when viewed in top-view. A dimension w12 in the X-direction of the second through-hole 164 is substantially constant at each position in the Y-direction. The dimension w12 in the X-direction of the second through-hole 164 is equal to the dimension w11 in the X-direction of the first through-hole 163 (w11=w12). The X-direction center position of the second through-hole 164 is positioned on the straight line L21 passing through the center position C2 of the second opening 124N.

As shown in FIGS. 3 and 6, each first through-hole 163 extends along the Y-direction over the range from directly under the first opening 124M to directly above the first nozzle hole 121M. As shown in FIGS. 4 and 6, each second through-hole 164 extends along the Y-direction over the range from directly under the second opening 124N to directly above the second nozzle hole 121N. As described above, the distance d1 in the Y-direction between the center position C1 of the first opening 124M and the center position C3 of the first nozzle hole 121M is less than the distance d2 in the Y-direction between the center position C2 of the second opening 124N and the center position C4 of the second nozzle hole 121N (d1<d2).

Accordingly, a dimension l11 of the first through-hole 163 in the Y-direction is less than a dimension l12 of the second through-hole 164 in the Y-direction (l11<l12).

Figure 7:
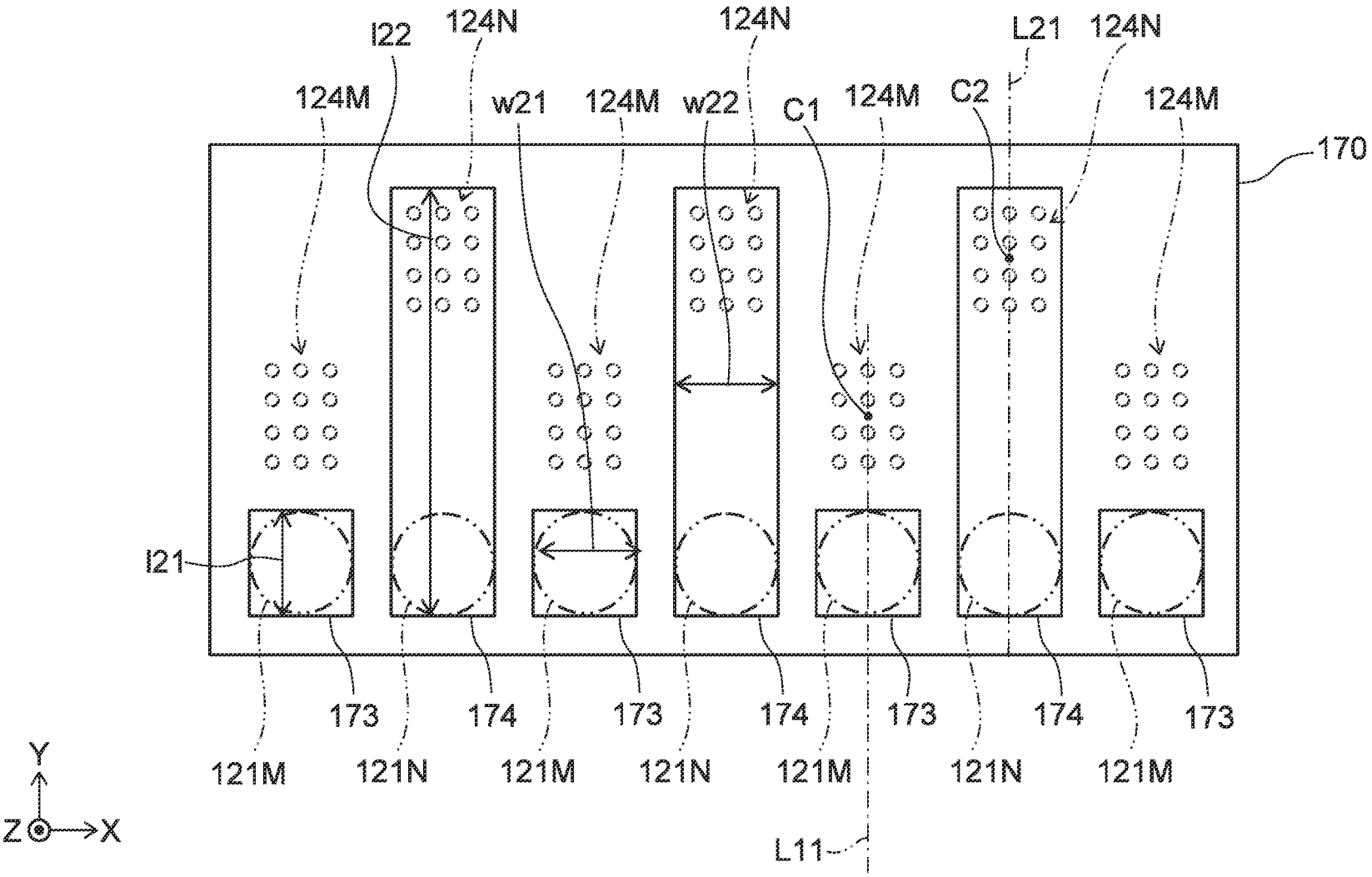
FIG. 7 is a top view showing a third plate of the ink head according to the first embodiment.

FIG. 7 is a top view showing the third plate of the ink head according to the embodiment.

Projections of the openings 124M and 124N and the nozzle holes 121M and 121N on the second plate 160 are illustrated by double dot-dash lines for easier understanding of the description in FIG. 7.

Multiple first through-holes 173 and multiple second through-holes 174 are provided in the third plate 170. The multiple first through-holes 173 and the multiple second through-holes 174 are alternately arranged in the X-direction.

Each first through-hole 173 is rectangular when viewed in top-view. A dimension w21 (the width) in the X-direction of each first through-hole 173 is substantially constant at each position in the Y-direction. The X-direction center position of the first through-hole 173 is positioned on the straight line L11 passing through the center position C1 of the first opening 124M.

Each second through-hole 174 is rectangular when viewed in top-view. A dimension w22 in the X-direction of the second through-hole 174 is substantially constant at each position in the Y-direction. The X-direction center position of the second through-hole 174 is positioned on the straight line L21 passing through the center position C2 of the second opening 124N.

The dimension w21 in the X-direction of each first through-hole 173 and the dimension w22 in the X-direction of each second through-hole 174 are substantially equal to the dimension w11 in the X-direction of the first through-hole 163 and the dimension w12 in the X-direction of the second through-hole 164 (w11=w12=w21=w22).

As shown in FIGS. 3 and 7, each first through-hole 173 is provided directly above the first nozzle hole 121M but not provided directly under the first opening 124M. As shown in FIGS. 4 and 7, each second through-hole 174 extends along the Y-direction over the range from directly under the second opening 124N to directly above the second nozzle hole 121N. A dimension l21 in the Y-direction of the first through-hole 173 is less than a dimension l22 in the Y-direction of the second through-hole 174 and the dimension l11 in the Y-direction of the first through-hole 163 of the second plate 160 (l21<l11<l22). The dimension l22 in the Y-direction of the second through-hole 174 is substantially equal to the dimension l12 in the Y-direction of the second through-hole 164 of the second plate 160 (l22=l12).

As shown in FIG. 3, the first flow channel 122M is defined by the lower surface 152 of the first plate 150, the first through-hole 163 of the second plate 160, and the first through-hole 173 and the upper surface 171 of the third plate 170. Therefore, the first flow channel 122M extends along the Y-direction over the range from directly under the first opening 124M to directly above the first nozzle hole 121M. The dimension (the flow channel length) in the Y-direction of the first flow channel 122M is equal to the dimension l11 in the Y-direction of the first through-hole 163.

The dimension (the height) in the Z-direction of the first flow channel 122M has a minimum at a Y-direction position between the first opening 124M and the first nozzle hole 121M. A minimum value h1 of the dimension in the Z-direction of the first flow channel 122M is substantially equal to the thickness of the second plate 160. The dimension (the width) in the X-direction of the first flow channel 122M is equal to the dimension w11 in the X-direction of the first through-hole 163 of the second plate 160 and the dimension w21 in the X-direction of the first through-hole 173 of the third plate 170.

As shown in FIG. 4, the second flow channel 122N is defined by the lower surface 152 of the first plate 150, the second through-hole 164 of the second plate 160, and the second through-hole 174 and the upper surface 171 of the third plate 170. Therefore, the second flow channel 122N extends along the Y-direction over the range from directly under the second opening 124N to directly above the second nozzle hole 121N. The dimension (the flow channel length) in the Y-direction of the second flow channel 122N is equal to the dimensions l12 and l22 in the Y-direction of the second through-holes 164 and 174. Accordingly, the dimension in the Y-direction of the second flow channel 122N is greater than the dimension in the Y-direction of the first flow channel 122M.

A minimum value h2 of the dimension (the height) in the Z-direction of the second flow channel 122N is substantially equal to the sum of the thickness of the second plate 160 and the thickness of the third plate 170. Therefore, the minimum value h2 of the dimension (the height) in the Z-direction of the second flow channel 122N is greater than the minimum value h1 of the dimension in the Z-direction of the first flow channel 122M (h2>h1). The dimension in the X-direction of the second flow channel 122N is equal to the dimension w12 in the X-direction of the second through-hole 164 of the second plate 160 and the dimension w22 in the X-direction of the second through-hole 174 of the third plate 170. Accordingly, the dimension in the X-direction of the second flow channel 122N is substantially equal to the dimension in the X-direction of the first flow channel 122M.

Figure 8:
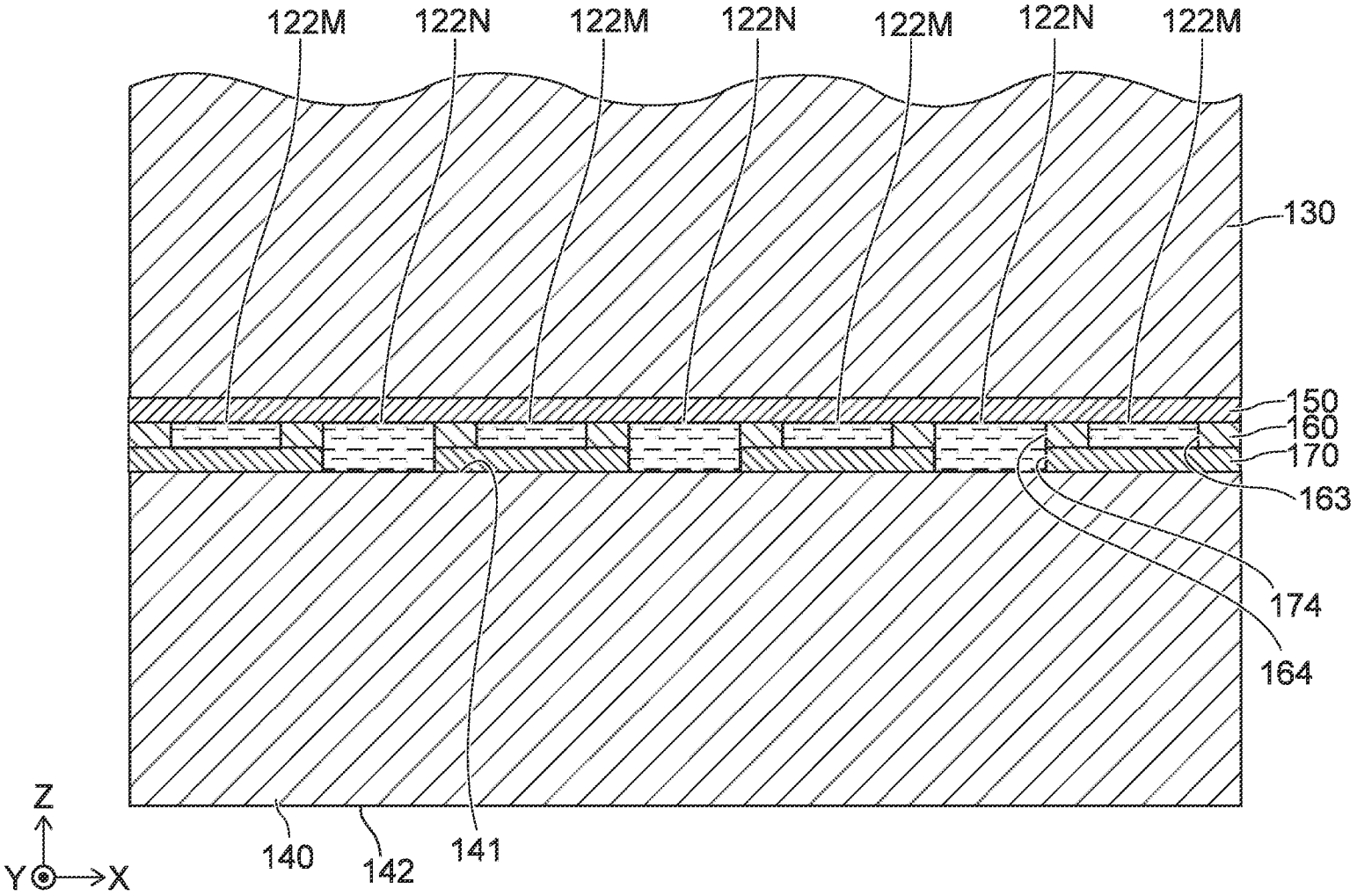
FIG. 8 is a cross-sectional view along line 8-8 of FIG. 1.

FIG. 8 is a cross-sectional view along line 8-8 of FIG. 1.

As described above, the surface area of the cross section orthogonal to the Y-direction of the first flow channel 122M has a minimum at a cross section positioned between the first opening 124M and the first nozzle hole 121M in the Y-direction as in the cross section along line 8-8 of FIG. 1. As shown in FIG. 8, the minimum surface area of the second flow channel 122N in the cross section orthogonal to the Y-direction is greater than the minimum surface area of the first flow channel 122M in the cross section orthogonal to the Y-direction.

As described above, the dimension (the flow channel length) in the Y-direction of the second flow channel 122N is greater than the dimension (the flow channel length) in the Y-direction of the first flow channel 122M. The flow channel resistance easily increases as the flow channel length increases. Conversely, in the embodiment as described above, the minimum surface area of the second flow channel 122N in the cross section orthogonal to the Y-direction is greater than the minimum surface area of the first flow channel 122M in the cross section orthogonal to the Y-direction, and the increase of the flow channel resistance of the second flow channel 122N is suppressed thereby. The minimum value of the surface area of the second flow channel in the cross section orthogonal to the Y-direction may be set to be greater than the minimum value of the surface area of the first flow channel in the cross section orthogonal to the Y-direction by setting the minimum value of the height of the first flow channel and the minimum value of the height of the second flow channel to be equal and by setting the minimum width of the second flow channel to be greater than the minimum width of the first flow channel.

It is favorable for the height, the width, and the cross-sectional area of the first flow channel 122M and the height, the width, and the cross-sectional area of the second flow channel 122N to be set so that the flow channel resistance when the ink K flows through the first flow channel 122M and the flow channel resistance when the ink K flows through the second flow channel 122N are equal.

Thus, as shown in FIG. 6, a distance d3 between the center position C1 of the first opening 124M and the center position C2 of the second opening 124N is greater than a distance d4 in the X-direction between the center position of the first flow channel 122M and the center position of the second flow channel (d3>d4).

Although the components of the ink head 100 are described above, the configuration of the ink head 100 is not limited to that described above. For example, the ink head 100 may not have a structure in which the first block 130, the second block 140, the first plate 150, the second plate 160, and the third plate 170 are stacked.

Operations of the embodiment will now be described.

As shown in FIG. 3, when a pulse voltage is applied to the piezoelectric element 123*a* of the first actuator 123M, the piezoelectric element 123*a* expands and contracts in the Z-direction. Therefore, the vibrating membrane 123*b* vibrates in the Z-direction. Thereby, a pressure wave of the ink K is produced inside the individual ink chamber 121*a* of the first nozzle hole 121M. As a result, the ink K protrudes from the nozzle hole tip 121*b* of the first nozzle hole 121M. The ink K that protrudes from the nozzle hole tip 121*b* gradually becomes large and separates from the first nozzle hole 121M. Thus, a droplet of the ink K is ejected from the first nozzle hole 121M.

At this time, the ink K of the common ink chamber 110 is suctioned into the first nozzle hole 121M via the first opening 124M and the first flow channel 122M. When a sufficient amount of the ink K is supplied thereby from the common ink chamber 110 to the individual ink chamber 121*a* of the first nozzle hole 121M, the ink K that protrudes from the nozzle hole tip 121*b* can grow to a sufficient size. As a result, a droplet that has a sufficient amount of the ink K can be ejected from the first nozzle hole 121M.

Similarly, as shown in FIG. 4, when a pulse voltage is applied to the piezoelectric element 123*a* of the second actuator 123N, the piezoelectric element 123*a* expands and contracts in the Z-direction. Therefore, the vibrating membrane 123*b* vibrates in the Z-direction. Thereby, a pressure wave of the ink K is produced inside the individual ink chamber 121*a* of the second nozzle hole 121N. As a result, the ink K protrudes from the nozzle hole tip 121*b* of the second nozzle hole 121N. The ink K that protrudes from the nozzle hole tip 121*b* gradually increases and separates from the second nozzle hole 121N. Thus, a droplet of the ink K is ejected from the second nozzle hole 121N.

At this time, the ink K of the common ink chamber 110 is suctioned into the second nozzle hole 121N via the second opening 124N and the second flow channel 122N. When a sufficient amount of the ink K is supplied thereby from the common ink chamber 110 to the individual ink chamber 121*a* of the second nozzle hole 121N, the ink K that protrudes from the nozzle hole tip 121*b* can grow to a sufficient size. As a result, a droplet that has a sufficient amount of the ink K can be ejected from the second nozzle hole 121N.

Figure 9A:
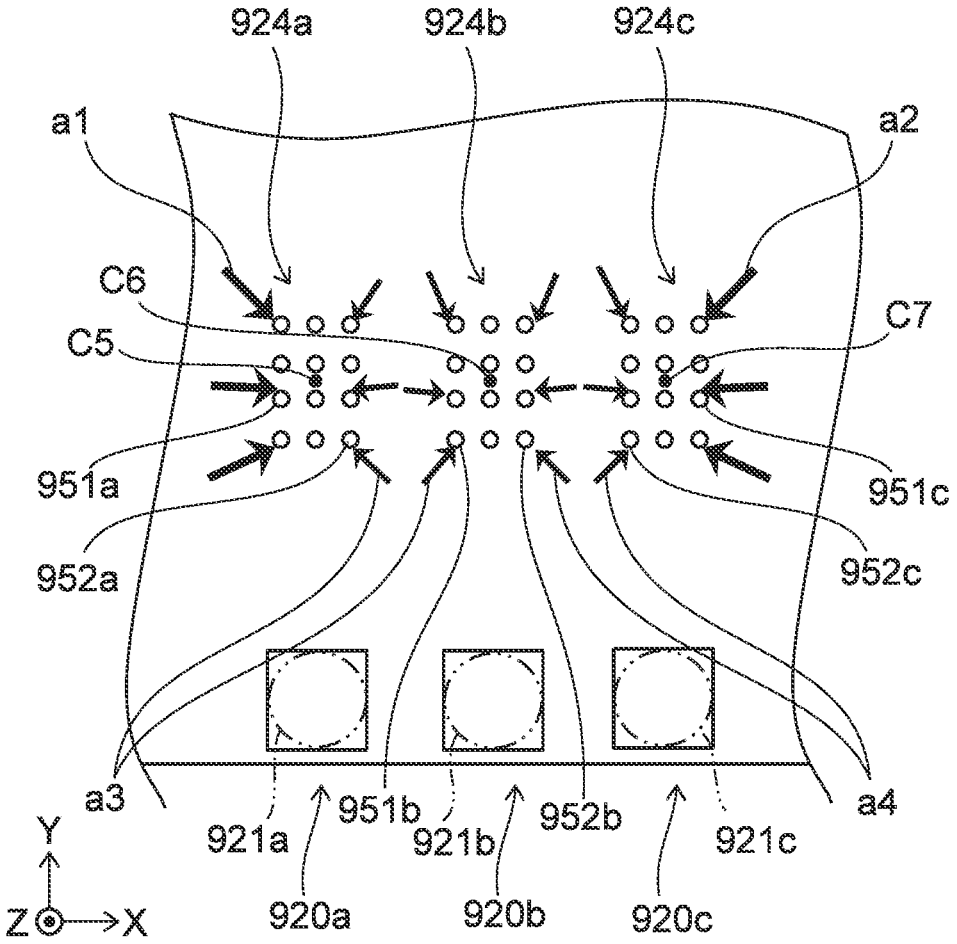
FIG. 9A is a schematic view illustrating flow of ink inside a common ink chamber when an openings of an ink head according to a reference example are viewed in top-view.
Figure 9B:
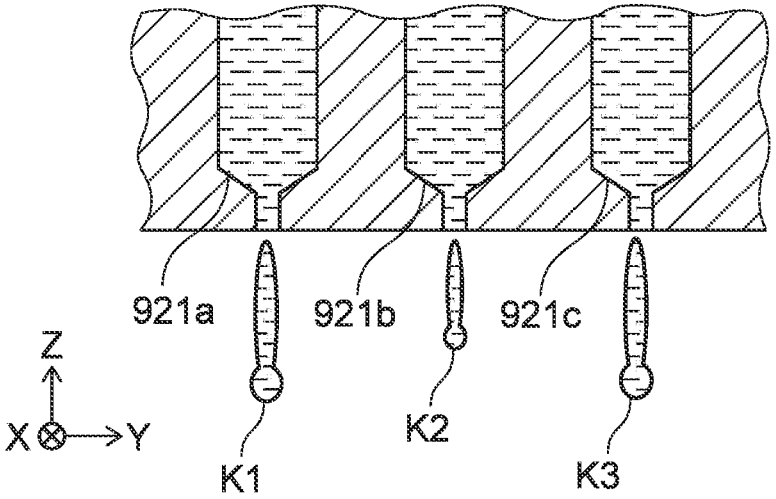
FIG. 9B is a schematic view illustrating droplets ejected from nozzle holes of the ink head according to the reference example.

FIG. 9A is a schematic view illustrating the flow of the ink inside the common ink chamber when the openings of an ink head according to a reference example are viewed in top-view, and FIG. 9B is a schematic view illustrating the droplets ejected from the nozzle holes of the ink head according to the reference example.

In FIG. 9A, arrows a1 to a4 show the directions of the flow of the ink, and the thicknesses of arrows a1 to a4 show the flow rate of the ink. In other words, the flow rate of the ink increases as the thickness of the arrow increases.

In the ink head 900 according to the reference example, a first nozzle 920*a*, a second nozzle 920*b*, and a third nozzle 920*c* are arranged in the X-direction. A center position C5 of a first opening 924*a* of the first nozzle 920*a*, a center position C6 of a second opening 924*b* of the second nozzle 920*b*, and a center position C7 of a third opening 924*c* of the third nozzle 920*c* are the same in the Y-direction. Therefore, the simultaneous ejection of the ink K from a first nozzle hole 921*a* of the first nozzle 920*a*, a second nozzle hole 921*b* of the second nozzle 920*b*, and a third nozzle hole 921*c* of the third nozzle 920*c* occurs as follows.

A sufficient amount of the ink K is suctioned via through-holes 951*a* of the multiple through-holes included in the first opening 924*a* that are not adjacent to the second opening 924*b* in the X-direction as shown by arrows a1. Similarly, a sufficient amount of the ink K is suctioned via through-holes 951*c* of the multiple through-holes included in the third opening 924*c* that are not adjacent to the second opening 924*b* in the X-direction as shown by arrows a2.

On the other hand, the ink K is simultaneously suctioned via through-holes 952*a* of the through-holes included in the first opening 924*a* that are adjacent to the second opening 924*b* in the X-direction and via through-holes 951*b* of the second opening 924*b* that are adjacent to the first opening 924*a* in the X-direction. Therefore, the ink K that exists inside the common ink chamber 110 at the periphery of the through-holes 951*b* and 952*a* is supplied by being dispersed among the through-holes 952*a* and 951*b*. Therefore, there is a possibility that a sufficient amount of the ink K may not be suctioned through the through-holes 952*a* and 951*b* as shown by arrows a3.

Similarly, the ink K is simultaneously suctioned via through-holes 952*c* of the third opening 924*c* that are adjacent to the second opening 924*b* in the X-direction and through-holes 952*b* of the second opening 924*b* that are adjacent to the third opening 924*c* in the X-direction. Therefore, the ink K that exists inside the common ink chamber 110 at the periphery of the through-holes 952*b* and 952*c* is supplied by being dispersed among the through-holes 952*b* and 952*c*. Therefore, there is a possibility that a sufficient amount of the ink K may not be suctioned through the through-holes 952*a* and 951*b* as shown by arrows a4.

Thus, there is a possibility that sufficient amounts of the ink K may not be supplied to the first and third nozzle holes 921*a* and 921*c*. In such a case, as shown in FIG. 9B, the amounts of droplets K1 and K3 of the ink K ejected respectively from the first and third nozzle holes 921*a* and 921*c* are less than the prescribed amounts. Also, there are cases where the ink K that is supplied to the second nozzle hole 921*b* is even less than the amounts of the ink K supplied to the first and third nozzle holes 921*a* and 921*c*. In such a case, as shown in FIG. 9B, the amount of a droplet K2 of the ink K ejected from the second nozzle hole 921*b* is even less than the amount of the droplet of the ink K ejected from the first nozzle hole 921*a*.

The flow of the ink K becomes difficult as the viscosity of the ink K increases. Therefore, as the viscosity of the ink K increases, the suction amount of the ink K easily decreases when the ink K is simultaneously ejected from adjacent nozzle holes. Also, the suction amount of the ink K easily decreases as the frequency of the pulse voltage applied to the piezoelectric element 123*a* increases because the suction interval of the ink K decreases.

Figure 10A:
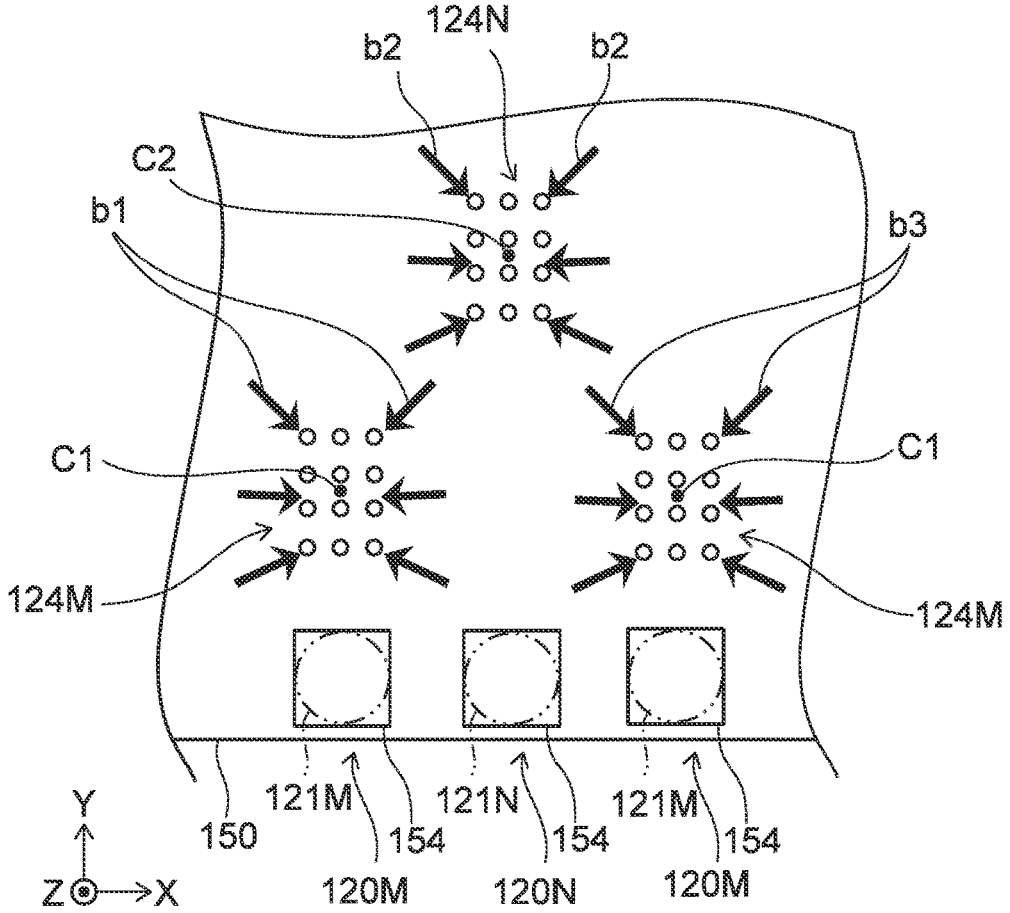
FIG. 10A is a schematic view illustrating flow of an ink inside a common ink chamber when an openings of the ink head according to the first embodiment are viewed in top-view.
Figure 10B:
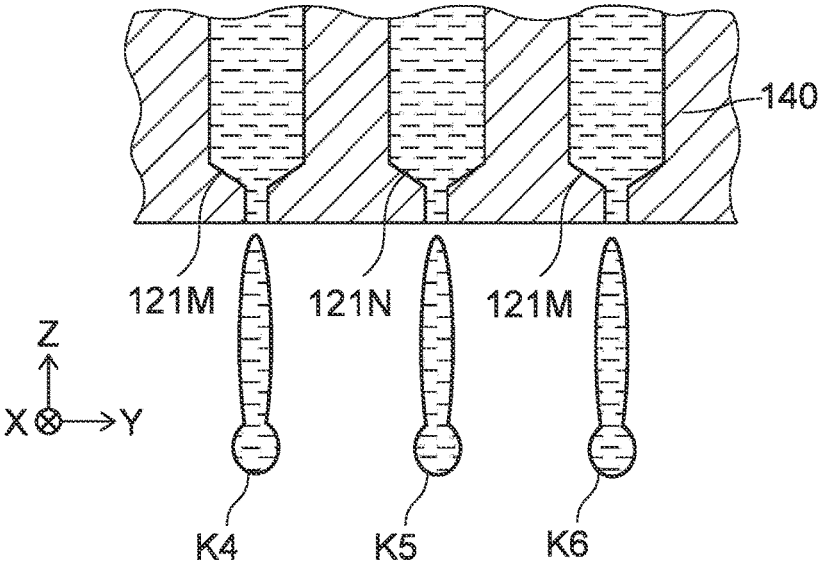
FIG. 10B is a schematic view illustrating droplets ejected from nozzle holes of the ink head according to the first embodiment.

FIG. 10A is a schematic view illustrating the flow of the ink inside the common ink chamber when the openings of the ink head according to the embodiment are viewed in top-view, and FIG. 10B is a schematic view illustrating the droplets ejected from the nozzle holes of the ink head according to the embodiment.

In FIG. 10A, arrows b1 to b4 show the directions of the flow of the ink, and the thicknesses of arrows b1 to b3 show the flow rate of the ink. In other words, the flow rate of the ink increases as the thickness of the arrow increases.

As shown in FIG. 10A, the center position C1 of the first opening 124M is shifted from the center position C2 of the second opening 124N in the Y-direction. Therefore, sufficient amounts of the ink K are suctioned through the openings 124M and 124N as shown by arrows b1, b2, and b3 when the ink K is simultaneously ejected from one second nozzle hole 121N and two first nozzle holes 121M adjacent to the second nozzle hole 121N in the X-direction. The amounts of the ink K suctioned through the openings 124M and 124N are substantially equal.

Thereby, sufficient amounts of the ink K are supplied to the nozzle holes 121M and 121N. As a result, as shown in FIG. 10B, the amounts of droplets K4, K5, and K6 of the ink K ejected from the nozzle holes 121M and 121N can be the prescribed amounts. Also, the amounts of the ink K ejected from the nozzle holes 121M and 121N can be uniform.

Although an example is described in which the ink simultaneously protrudes from adjacent first nozzle holes 121M and second nozzle holes 121N, the ink may not always protrude simultaneously from the adjacent first nozzle holes 121M and second nozzle holes 121N.

Effects of the embodiment will now be described.

The ink head 100 according to the embodiment includes: the common ink chamber 110 that is configured to contain the ink K; the first nozzle 120M that includes the first nozzle hole 121M, the first flow channel 122M linking the first nozzle hole 121M and the common ink chamber 110, and the first actuator 123M ejecting the ink K from the first nozzle hole 121M; and the second nozzle 120N that is adjacent to the first nozzle 120M in the first direction (the X-direction) and includes the second nozzle hole 121N, the second flow channel 122N linking the second nozzle hole 121N and the common ink chamber 110, and the second actuator 123N ejecting the ink K from the second nozzle hole 121N. The first flow channel 122M is linked to the common ink chamber 110 via the first opening 124M. The second flow channel 122N is linked to the common ink chamber 110 via the second opening 124N. When viewed along the second direction (the downward direction) from the common ink chamber 110 toward the first flow channel 122M, the center position C1 of the first opening 124M is shifted from the center position C2 of the second opening 124N in the third direction (the Y-direction), which crosses the first direction (the X-direction).

Thereby, the ink head 100 can be realized in which the prescribed amounts of ink K can be ejected from the nozzle holes 121M and 121N.

The range S12 in which the first opening 124M is provided and the range S22 in which the second opening 124N is provided do not overlap in the third direction (the Y-direction). Thereby, the first opening 124M and the second opening 124N are prevented from being adjacent, and sufficient amounts of the ink K can be supplied from the common ink chamber 110 to the nozzle holes 121M and 121N.

The first flow channel 122M and the second flow channel 122N extend in the third direction (the Y-direction). The distance d3 between the center position C1 of the first opening 124M and the center position C2 of the second opening 124N is greater than the distance d4 in the first direction (the X-direction) between the center position of the first flow channel 122M and the center position of the second flow channel 122N (d3>d4). Thereby, the first opening 124M and the second opening 124N can be prevented from being adjacent, and sufficient amounts of the ink K can be supplied from the common ink chamber 110 to the nozzle holes 121M and 121N.

The position of the first nozzle hole 121M and the position of the second nozzle hole 121N are the same in the third direction (the Y-direction). The distance d2 in the third direction (the Y-direction) between the center position C2 of the second opening 124N and the center position C4 of the second nozzle hole 121N is greater than the distance d1 in the third direction between the center position C1 of the first opening 124M and the center position C3 of the first nozzle hole 121M (d2>d1). Thereby, the first opening 124M and the second opening 124N can be prevented from being adjacent in the first direction (the X-direction) while aligning the positions in the third direction (the Y-direction) of the first and second nozzle holes 121M and 121N.

In such a configuration, the flow channel length of the second flow channel 122N is greater than the flow channel length of the first flow channel 122M. Conversely, in the embodiment, the minimum surface area of the second flow channel 122N in the cross section orthogonal to the third direction (the Y-direction) is greater than the minimum surface area of the first flow channel 122M in the cross section orthogonal to the third direction (the Y-direction). Thereby, the flow channel resistance of the second flow channel 122N can be reduced compared to the case where the minimum surface area of the second flow channel 122N in the cross section orthogonal to the third direction (the Y-direction) is not more than the minimum surface area of the first flow channel 122M in the cross section orthogonal to the third direction (the Y-direction).

The minimum value h2 of the dimension in the second direction (the downward direction) of the second flow channel 122N is greater than the minimum value h1 of the dimension in the second direction (the downward direction) of the first flow channel 122M (h2>h1). Thereby, the flow channel resistance of the second flow channel 122N can be reduced compared to the case where the minimum value h2 of the dimension in the second direction (the downward direction) of the second flow channel 122N is not more than the minimum value h1 of the dimension in the second direction (the downward direction) of the first flow channel 122M.

Second Embodiment

A second embodiment will now be described.

Figure 11:
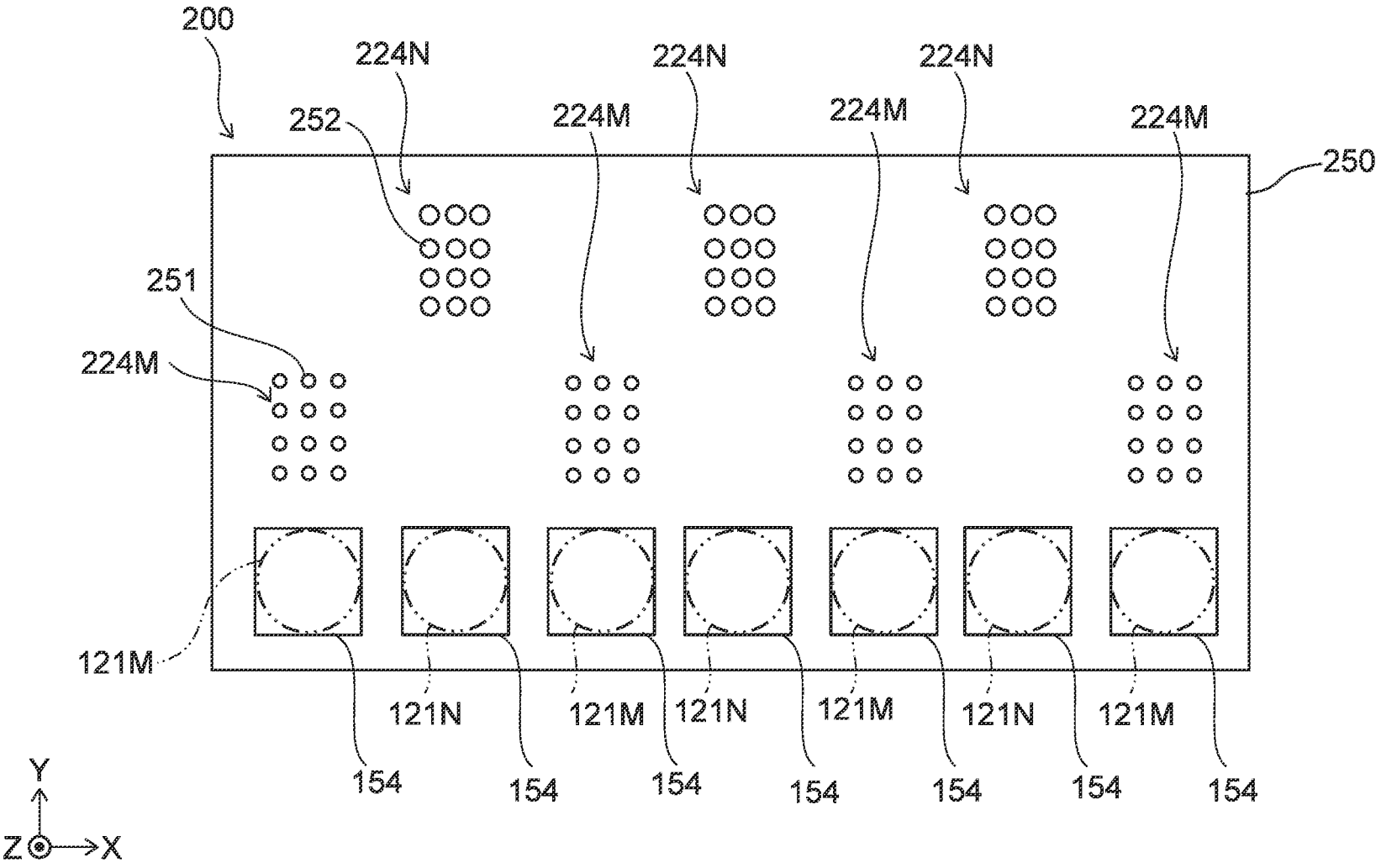
FIG. 11 is a top view showing a first plate of an ink head according to a second embodiment.

FIG. 11 is a top view showing the first plate of an ink head according to the embodiment.

The ink head 200 according to the embodiment differs from the ink head 100 according to the first embodiment in that the surface area of a first opening 224M and the surface area of a second opening 224N are not equal.

As a general rule in the following description, only the differences with the first embodiment are described. The ink head 200 is similar to that of the first embodiment other than the items described below.

The multiple first openings 224M and the multiple second openings 224N are provided in a first plate 250.

In the embodiment, each first opening 224M is made of multiple first through-holes 251 extending through the first plate 250 in the Z-direction. Each first through-hole 251 is circular when viewed in top-view.

In the embodiment, each second opening 224N is made of multiple second through-holes 252 extending through the first plate 250 in the Z-direction. Each second through-hole 252 is circular when viewed in top-view. The diameter of the second through-hole 252 is greater than the diameter of the first through-hole 251. Therefore, the surface area of the second opening 224N is greater than the surface area of the first opening 224M. The "surface area of the opening" means the total area of the region through which the ink can flow when the opening is viewed in plan, and means the sum of the surface areas of the multiple through-holes when viewed in plan when the opening is made of multiple through-holes. Thereby, the resistance when the ink K flows into the second opening 224N can be reduced compared to the case where the surface area of the second opening 224N is not more than the surface area of the first opening 224M.

Examples are described in the first and second embodiments in which the flow channels extend in the direction (the third direction) in which the center position of the first opening and the center position of the second opening are shifted. However, the direction in which the flow channels extend may not match the direction of the shift of the center position of the first opening and the center position of the second opening.

Although the ink head includes the multiple first nozzles and the multiple second nozzles in the first and second embodiments, the ink head also may include third nozzles, and the center positions of third openings of the third nozzles may be shifted from the center position of the first opening and the center position of the second opening in the third direction when viewed along the second direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Additionally, the embodiments described above can be combined mutually.

What is claimed is:

1. An ink head, comprising:

a common ink chamber configured to contain ink;

a first nozzle including a first nozzle hole, a first flow channel linking the first nozzle hole and the common ink chamber, and a first actuator ejecting ink from the first nozzle hole; and a second nozzle including a second nozzle hole, a second flow channel linking the second nozzle hole and the common ink chamber, and a second actuator ejecting ink from the second nozzle hole, the second nozzle being adjacent to the first nozzle in a first direction, the first flow channel being linked to the common ink chamber via a first opening, the second flow channel being linked to the common ink chamber via a second opening, a center position of the first opening being shifted from a center position of the second opening in at least a third direction, the third direction crossing the first direction when viewed along a second direction, the second direction being from the common ink chamber toward the first flow channel.

2. The ink head according to claim 1, wherein a range in which the first opening is provided and a range in which the second opening is provided do not overlap in the third direction.

3. The ink head according to claim 2, wherein the first flow channel and the second flow channel extend in the third direction, and a distance between the center position of the first opening and the center position of the second opening is greater than a distance in the first direction between a center of the first flow channel and a center of the second flow channel.

4. The ink head according to claim 3, wherein a position of the first nozzle hole in the third direction and a position of the second nozzle hole in the third direction are the same, and a distance in the third direction between the second opening and the second nozzle hole is greater than a distance in the third direction between the first opening and the first nozzle hole.

5. The ink head according to claim 3, wherein a minimum value of a dimension in the second direction of the second flow channel is greater than a minimum value of a dimension in the second direction of the first flow channel.

6. The ink head according to claim 5, wherein a surface area of the second opening is greater than a surface area of the first opening when viewed along the second direction.

7. The ink head according to claim 4, wherein a minimum surface area of the second flow channel in a cross section orthogonal to the third direction is greater than a minimum surface area of the first flow channel in a cross section orthogonal to the third direction.

8. The ink head according to claim 4, wherein a minimum value of a dimension in the second direction of the second flow channel is greater than a minimum value of a dimension in the second direction of the first flow channel.

9. The ink head according to claim 8, wherein a surface area of the second opening is greater than a surface area of the first opening when viewed along the second direction.

10. The ink head according to claim 4, wherein a surface area of the second opening is greater than a surface area of the first opening when viewed along the second direction.

11. The ink head according to claim 7, wherein a surface area of the second opening is greater than a surface area of the first opening when viewed along the second direction.

12. The ink head according to claim 1, wherein the first flow channel and the second flow channel extend in the third direction, and a distance between the center position of the first opening and the center position of the second opening is greater than a distance in the first direction between a center of the first flow channel and a center of the second flow channel.

13. The ink head according to claim 12, wherein a position of the first nozzle hole in the third direction and a position of the second nozzle hole in the third direction are the same, and a distance in the third direction between the second opening and the second nozzle hole is greater than a distance in the third direction between the first opening and the first nozzle hole.

14. The ink head according to claim 12, wherein a minimum value of a dimension in the second direction of the second flow channel is greater than a minimum value of a dimension in the second direction of the first flow channel.

15. The ink head according to claim 14, wherein a surface area of the second opening is greater than a surface area of the first opening when viewed along the second direction.

16. The ink head according to claim 13, wherein a minimum surface area of the second flow channel in a cross section orthogonal to the third direction is greater than a minimum surface area of the first flow channel in a cross section orthogonal to the third direction.

17. The ink head according to claim 13, wherein a minimum value of a dimension in the second direction of the second flow channel is greater than a minimum value of a dimension in the second direction of the first flow channel.

18. The ink head according to claim 17, wherein a surface area of the second opening is greater than a surface area of the first opening when viewed along the second direction.

19. The ink head according to claim 13, wherein a surface area of the second opening is greater than a surface area of the first opening when viewed along the second direction.

20. The ink head according to claim 16, wherein a surface area of the second opening is greater than a surface area of the first opening when viewed along the second direction.

* * * * *